US005276988A

United States Patent [19]

Swan

[11] Patent Number: 5,276,988

[45] Date of Patent: Jan. 11, 1994

[54] BUFFERED ATTACHMENT DEVICE

[76] Inventor: Richard E. Swan, 375 West Street, E. Bridgewater, Mass. 02379

[21] Appl. No.: 973,409

[22] Filed: Nov. 9, 1992

[51] Int. Cl.[5] ..... F41G 1/387

[52] U.S. Cl. ..... 42/101; 33/250

[58] Field of Search ..... 42/101, 99, 90; 33/250

[56] References Cited

U.S. PATENT DOCUMENTS 4,085,511 4/1978 Kovac ..... 33/250

4,205,473 6/1980 Wilson ..... 42/101

4,845,871 7/1989 Swan ..... 42/101

5,142,806 9/1992 Swan ..... 42/101

*Primary Examiner*—David H. Brown

*Attorney, Agent, or Firm*—John P. McGonagle

[57] ABSTRACT

A buffered means for attaching a first device to a second device. The attachment means includes a camming surface. The invention provides a buffer element between the attachment device camming surface and the area to which the attachment device is affixed.

11 Claims, 6 Drawing Sheets

BUFFERED ATTACHMENT DEVICE

BACKGROUND OF THE INVENTION

This invention relates to attachment means and more particularly to a buffered means for attaching a device to a weaver or angled railing.

In applicant's U.S. Pat. No. 4,845,871, issued on Jul. 11, 1989, for an "Attachment Device", and incorporated herein by reference, (hereinafter: '871 Attachment Device), there was disclosed a fastening device comprising a locking means and an actuating means. The locking means included a base portion with first and second camming areas The '871 attachment device is used to provide a portable integrator for various add on devices, such as the locking weaver interface 33 of the '871 patent onto a first weaver interface 28 or onto a receiver sleeve as disclosed in applicant's copending application, Ser. No. 07/763,966, now U.S. Pat. No. 5,142,806, incorporated herein by reference, or directly onto the upper receiver of a firearm. The '871 attachment device is also sometimes referred to as a "throw lever", and may be used in tandem as seen in the '871 patent or singularly for applications like optics ring holders.

The limitation of the '871 Attachment Device and similar type devices lies in the camming areas. Weaver interfaces, receiver sleeves and upper receivers are generally made of aluminum or other light weight material. These materials are softer than the steel used for and necessary to make the camming areas of the '871 Attachment Device and similar type devices. Thus, over time and after repeated use, the '871 attachment device continuously scratches, cuts and erodes the area to which the '871 attachment device is affixed.

SUMMARY OF THE INVENTION

In view of the foregoing disadvantage inherent in the '871 Attachment Device, the present invention provides an improved attachment device. As such, the general purpose of the present invention, which will be described subsequently in greater detail, is to provide a new and improved fastening device which eliminates the problem of the '871 Attachment Device and similar type devices cutting into the softer material of the area to which the '871 attachment device is affixed.

To attain this result, the present invention provides a buffer element between the attachment device camming surfaces and the area to which the attachment device is affixed.

This together with other objects of the invention, along with various features of novelty which characterize the invention, are pointed out with particularity in the claims annexed hereto and forming a part of this disclosure. For a better understanding of the invention, its operating advantages and the specific objects attained by its uses, reference should be had to the accompanying drawings and descriptive matter in which there is illustrated a preferred embodiment of the invention.

DETAILED DESCRIPTION OF THE INVENTION

Figure 1:
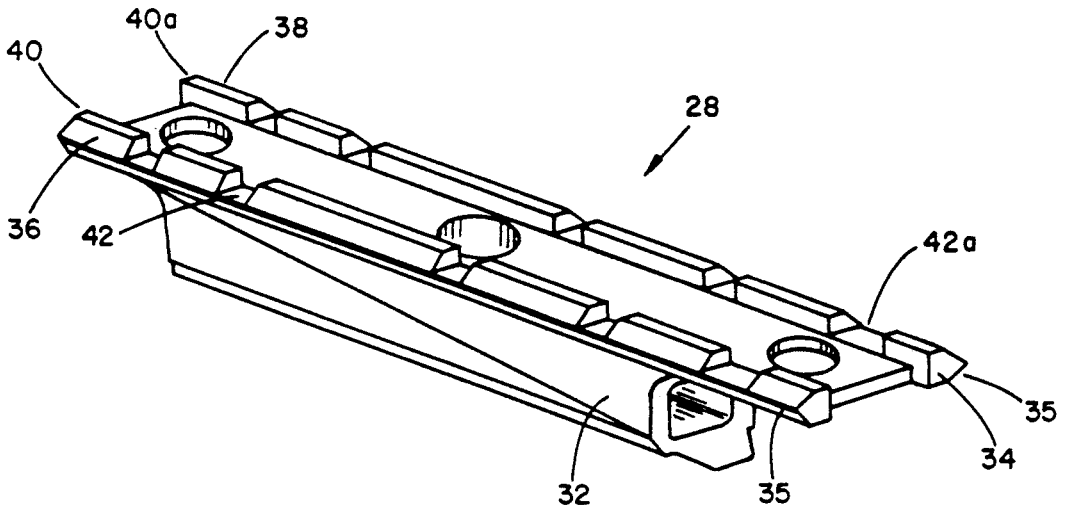
FIG. 1 is a perspective view of a first weaver interface.
Figure 2:
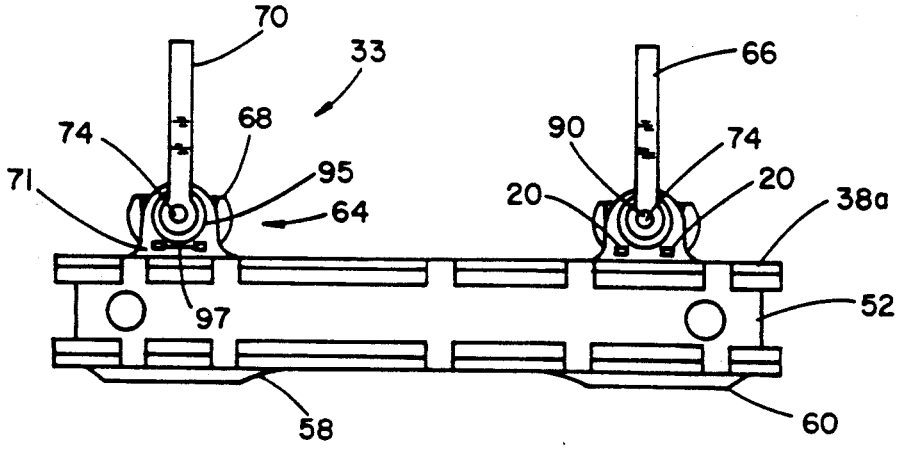
FIG. 2 is a top plan view of a weaver rail with a buffered attachment device constructed according to the present invention integrated therein.
Figure 3:
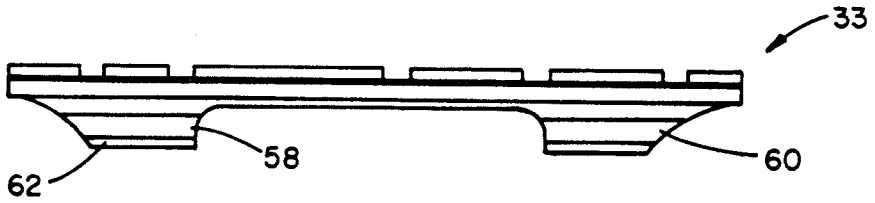
FIG. 3 is a side elevational view of the rail of FIG. 2.
Figure 4:
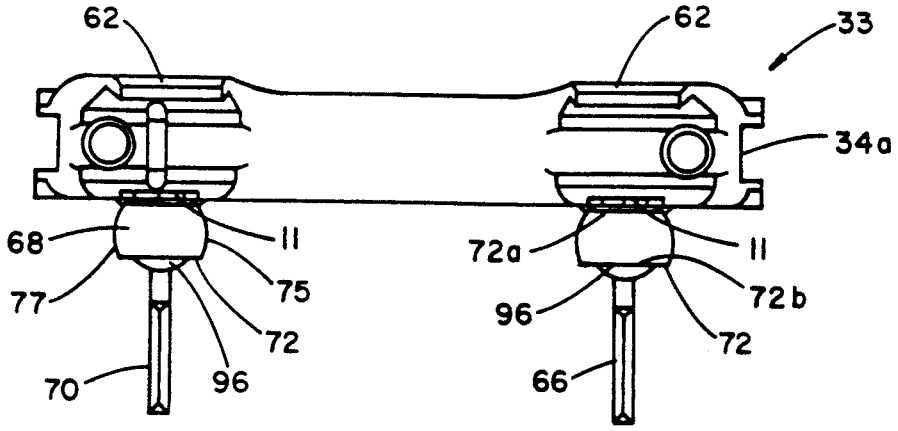
FIG. 4 is a bottom plan view of the rail shown in FIG. 2.
Figure 6A:
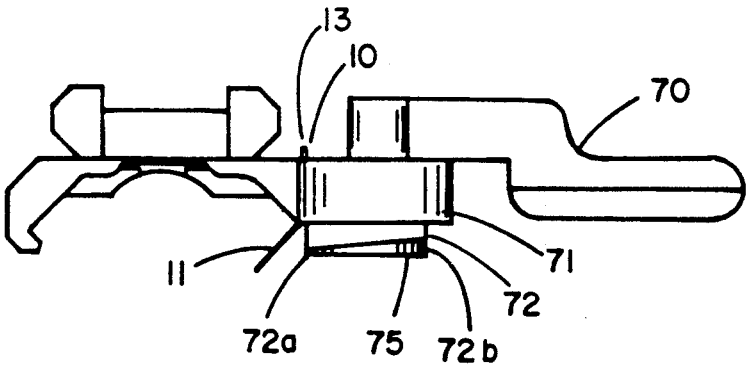
FIG. 6A is a front elevational view of the buffered attachment device attached to the weaver rail shown in FIG. 2 with the attachment means attached thereto.

For purposes of illustration, it will be assumed that the buffered attachment device of the present invention will be integrated with a locking weaver interface 33 for attachment to a first weaver interface or similar type device. Notwithstanding this, it must be emphasized that the buffered attachment device is designed for use with any angled railing.

Referring to the drawings in detail wherein like elements are indicated by like numerals, there is shown extending from said locking weaver interface 33 a buffered attachment device 64 comprised of a locking means 68, actuating means 70 and, as used in the example disclosed therein, a support 71. The locking means 68 includes a base portion 72 and a shaft 74 interconnecting the locking means 68 with said actuating means 70. The base portion 72 is defined by first and second edges **72*a*, 72*b* which are in spaced parallel relation to each other and connected at one end by a first arced portion 75 and at the other end by a second arced portion 77. The upper surface of the first arced portion 75 of the base portion 72 includes a camming area 79 and the upper surface of the second arced portion 77 of the base portion 72 includes a second camming area 81. The first and second camming area 79, 81 each have at least two portions beginning with the one nearest the first edge 72*a*** of increasing sharpness of slope.

The support 71 is integral with an interface device, such as the locking weaver interface 33 of the '871 patent. The locking weaver interface 33 has an engagement portion 58 extending from a portion of one 31 of the long side edges of the support portion **34*a* in close proximity to one end thereof and beyond the area defined by the support portion 34*a* and lies on a horizontal plane below the bottom surface of the portion 52. The engagement portion 58 includes an inturned angular grip portion 62. The buffered attachment device 64 extends from a portion of the other long side edge 30 of the support portion 34*a* in close proximity to one end thereof and in opposed relation to the engagement portion 58. The support 71 is integral with the long side edge, and includes an uppermost surface 95, a lowermost surface 96 and has a first aperture 90 formed there through and in right angle relation thereto. The shaft 74 is attached to the base 72 and protrudes through the support aperture 90**.

Referring to the drawings in general, and particularly FIGS. 7A–8B, there is shown a generally U-shaped buffer element 10 having a flat horizontal base portion 11 with an arm 12 at each end of the base 11 extending upwardly at an oblique angle of 135 degrees. The free end 13 of each arm is curved forward toward the plane of the base portion 11 approximately 150 degrees.

Two side-by-side openings 20, corresponding in separation to the separation between buffer element arms 12, are formed in the fastening device support 71 between the support aperture 90 and the side edge 30 in parallel relationship to said side edge 30. The buffer element 10 is slid through the openings 20, vertical arm free ends 13 first, from lowermost surface 96 through to uppermost surface 95, said arm free ends 13 curving toward said aperture 90.

Engagement of the interface device 33 with a first weaver interface 28 or receiver with a universal receiver sleeve as described in applicant's copending application, Ser. No. 07/763,966, incorporated herein by reference, is accomplished by positioning the inturned angular grip portion 62 of the interface device 33 under and in abutting relationship with the engagement surface of the second rail 38 of said first weaver interface 28 or receiver sleeve. The first edge **72*a* of the base portion 72 is positioned in close proximity to the engagement surface 35 of the first rail 36 of said first weaver interface 28 or receiver sleeve. The buffer element base portion 11 is positioned between said first edge 72*a* and said engagement surface 35. Rotation of the throw lever 70 in a clockwise direction causes the first camming area 79 to press the buffer element base portion 11, in abutting relation, under the engagement surface 35 of the first rail 36. The configuration of the buffered interface device 33 causes the interface to be drawn vertically downward onto the first weaver interface 28. The buffer element 10 prevents the cam 72 from directly touching and thereby scratching the engagement surface 35**.

To prevent the loose fitting buffer element 10 from interfering with the initial positioning of the interface 33 onto the weaver interface 28, a spring wire 15 is installed to hold the buffer element base portion 11 against the cam 72. The uppermost support surface 95 has a horizontal groove 97 formed between the openings 20. The groove 97 interconnects the openings 20 near to the side edge 30. A short length of 30/1000 inch piano wire 15 is inserted into the groove 20 on the aperture 90 side of the buffer element arms 12 at the beginning portion 14 of the curved free ends 13. Positioning of the spring 15 in this manner, holds the buffer element base portion 11 toward the cam 72. Rotation of the throw lever 70 and the consequent movement of the first camming area 79 against the buffer element base portion 11 overcomes the resistance of the spring 15 and moves the buffer element base portion 11 under and against the engagement surface 35 of the first rail 36.

Figure 5A:
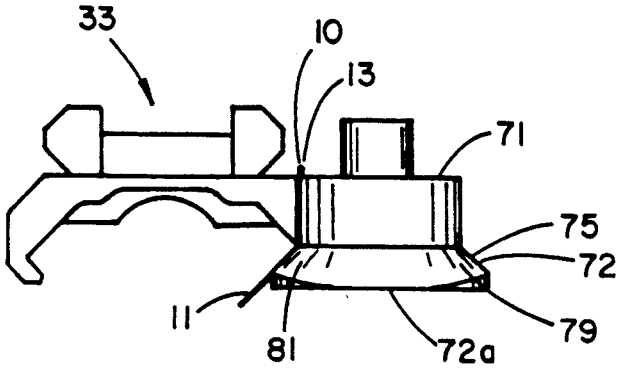
FIG. 5A is a front elevational view of the buffered attachment device attached to the weaver rail shown in FIG. 2 without the actuating means attached thereto.
Figure 5B:
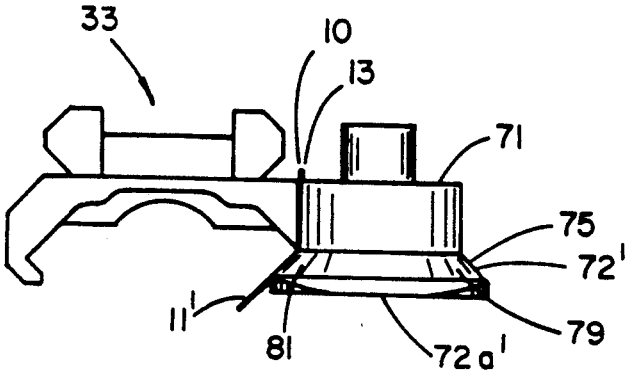
FIG. 5B is a front elevational view of the buffered attachment device of FIG. 5A with magnetized locking means.
Figure 6B:
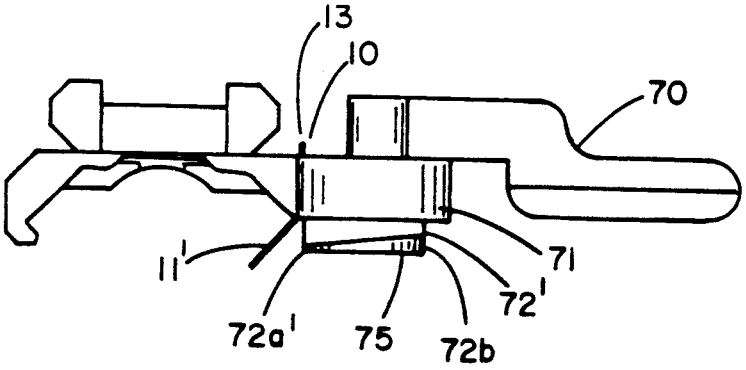
FIG. 6B is a front elevational view of the buffered attachment device of FIG. 6A with magnetized locking means.
Figure 7A:
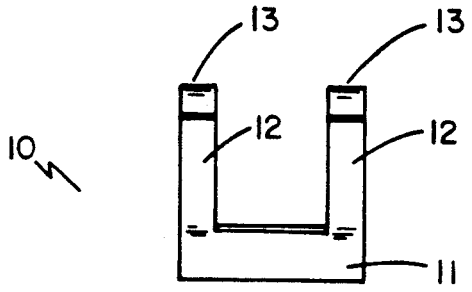
FIGS. 7A and 7B are front and side elevational views of a buffer element according to the present invention.
Figure 7B:
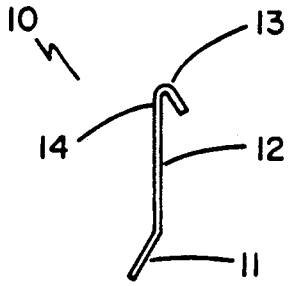
Figure 8A:
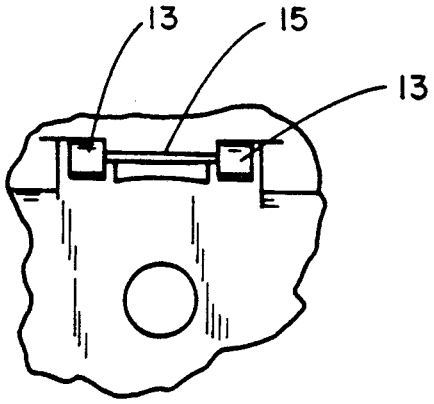
FIGS. 8A and 8B are top and side elevational views of the invention used in conjunction with a spring wire.
Figure 8B:
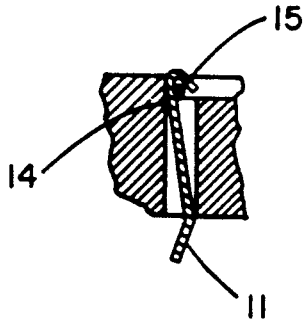
Figure 10:
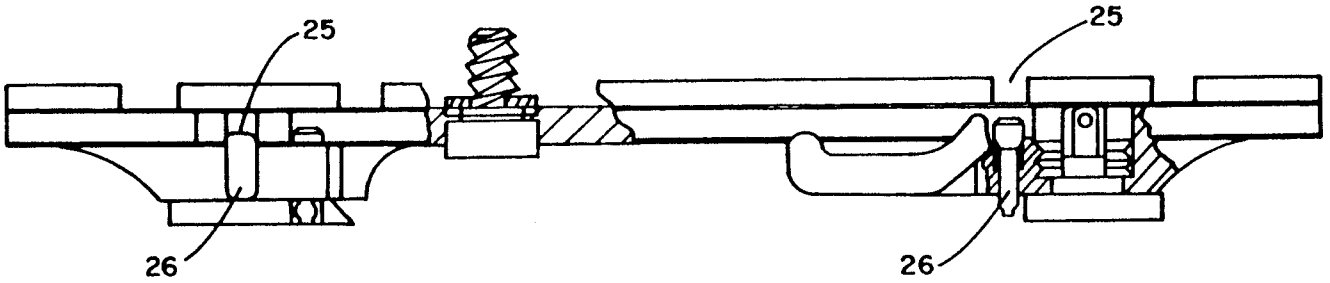
FIG. 10 is a side elevational view of the rail of FIG. 9.
Figure 9:
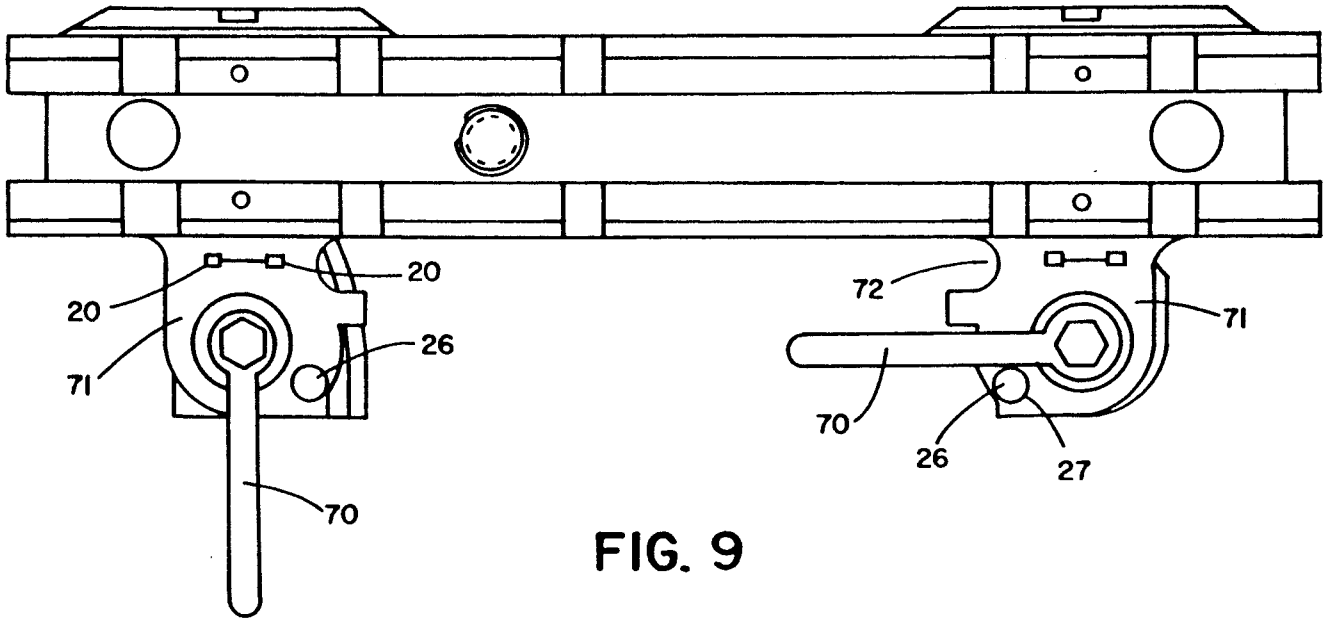
FIG. 9 is a top plan view of a weaver rail with a buffered attachment device constructed according to the present invention integrated therein and having a spring loaded pin.

In an alternative embodiment, as shown in FIGS. 5B and 6B, the spring 15 may be eliminated and the fastening device base portion 72 (hereinafter 72') magnetized. The buffer element base portion 11 (hereinafter 11') would then hold the buffer element to the cam 72 through magnetic attraction. Although this embodiment would not be used in applications where equipment sensitive to magnetic distortions was being integrated, for many other applications is would be useful.

In still another embodiment of the invention, a lever locking mechanism is integrated into the fastening device 64. A fourth opening 25 is formed in the fastening device support 71 on the throw lever 70 side of the aperture 90 mid way between the throw lever's open position A and the throw lever's closed position B. A spring loaded pin 26 is inserted into the opening 25. The fastening device base portion 72 has a notch 85 formed therein. When the throw lever 70 is in position A, the notch fits around the protruding portion 27 of the pin 26. When the throw lever 70 is moved from position A to position B, the pin 26 is depressed so that the throw lever 70 may pass by the pin 26. The pin 26 springs back when the throw lever 70 is moved into position B. The throw lever 70 is held in position B by the pin 26 and cannot be moved back to position A until the pin 26 is depressed again.

It is understood that the above-described embodiment is merely illustrative of the application. Other embodiments may be readily devised by those skilled in the art which will embody the principles of the invention and fall within the spirit and scope thereof.

I claim:

1. In a fastening device for attaching a first device to a second device, said fastening device being integrated with said first device and having a support interconnecting said fastening device with said first device, said fastening device having a locking means with a camming surface adapted to engage said second device, and an actuating means attached to said locking means, said actuating means having a normally open position and a normally closed position, said support holding said locking means and said actuating means by means of a shaft attached to said locking means and positioned through a first aperture in said support to said actuating means, a buffer comprising:.

a generally U-shaped buffer element having a flat base portion with an arm at each end of the base, said arms being in parallel with each other and formed transverse to the longitudinal axis of said base, said arms extending away from said base at an oblique angle;

wherein said fastening device support has two side-by-side openings formed therein near to said first device, corresponding in separation to the separation between buffer element arms; and wherein said buffer element is attached to said support by means of said element arms being fitted into and through said openings; and wherein said flat base portion is positioned between said locking means camming surface and said second device.

2. A fastening device in accordance with claim 1, wherein:

said buffer element unattached arm ends are positioned through said side-by-side support openings from lowermost surface through to uppermost surface, said arm free ends curving toward said first aperture and said buffer element flat horizontal base portion being positioned below the support lowermost surface.

3. A buffered attachment device in accordance with claim 2, further comprising:

a magnetized locking means base portion for holding the buffer element base against a camming area.

4. A fastening device in accordance with claim 2, further comprising:

a horizontal groove formed on the uppermost support surface between and interconnecting the side-by-side openings;

a short length of spring wire inserted into said groove;

wherein the curved free ends of the buffer element unattached arm ends are positioning over the spring wire thereby holding the buffer element base portion toward the camming surfaces; and wherein rotation of the actuating means and the consequent movement of a camming area against the buffer element base portion overcomes the resistance of the spring and moves the buffer element base portion along with the camming area.

5. A fastening device in accordance with claim 4, further comprising:

a fourth opening formed in the fastening device support away from said first device mid way between said actuating device normally open and normally closed positions;

a spring loaded pin with a protruding portion fitted into said fourth opening;

a notch formed in said fastening device base portion, wherein when the actuating device is in a normally open position, the notch fits around the protruding portion of the pin and when the actuating device is moved from a normally open to a normally closed position, the pin is depressed so that actuating means may pass by the pin;

wherein the pin springs back when the actuating means is moved into a normally closed position.

6. A buffered attachment device extending from an angled/railing, comprising:

a support integral with said railing, and having an uppermost surface, a lowermost surface and a first aperture formed therethrough and in right angle relation thereto;

an actuating means having a normally open position and a normally closed position;

a locking means having a base portion and a shaft attached to said base portion, said shaft protruding through said support first aperture and interconnecting said locking means at the support lowermost surface with said actuating means at the support uppermost surface, wherein said locking means base portion is defined by first and second edges which ar in spaced parallel relation to each other and connected at one end by a first arced portion and at the other end by a second arced portion, the upper surface of the first arced portion of the base portion including a camming area and the upper surface of the second arced portion of the base portion including a second camming area; and a generally U-shaped buffer element having a flat horizontal base portion with an arm attached at each end of the base extending upwardly at an oblique angle, the unattached end of each arm being curved toward the plane of the base, wherein said flat base is positioned adjacent said camming surfaces.

7. A buffered attachment device in accordance with claim 6, further comprising:

two side-by-side openings, corresponding in separation to the separation between buffer element arms, formed in the said support between the first support aperture and the angled railing.

8. A buffered attachment device in accordance with claim 7, wherein:

said buffer element unattached arm ends are positioned through said side-by-side support openings from lowermost surface through to uppermost surface, said arm free ends curving toward said first aperture and said buffer element flat horizontal base portion being positioned below the support lowermost surface.

9. A buffered attachment device in accordance with claim 8, further comprising:

a magnetized locking means base portion for holding the buffer element base against a camming area.

10. A buffered attachment device in accordance with claim 8, further comprising:

a horizontal groove formed on the uppermost support surface between and interconnecting the side-by-side openings;

a short length of spring wire inserted into said groove;

wherein the curved free ends of the buffer element unattached arm ends are positioning over the spring wire thereby holding the buffer element base portion toward the camming surfaces; and wherein rotation of the actuating means and the consequent movement of a camming area against the buffer element base portion overcomes the resistance of the spring and moves the buffer element base portion along with the camming area.

11. A buffered attachment device in accordance with claim 10, further comprising:

a fourth opening formed in the fastening device support away from said first device mid way between said actuating device normally open and normally closed positions;

a spring loaded pin with a protruding portion fitted into said fourth opening;

a notch formed in said fastening device base portion, wherein when the actuating device is in a normally open position, the notch fits around the protruding portion of the pin and when the actuating device is moved from a normally open to a normally closed position, the pin is depressed so that actuating means may pass by the pin;

wherein the pin springs back when the actuating means is moved into a normally closed position.

* * * * *